United States Patent [19]

Bavaveas

[11] 4,035,090

[45] July 12, 1977

[54] APPLICATOR

[75] Inventor: Payanotis Bavaveas, Paris, France

[73] Assignee: Eparco SA., France

[21] Appl. No.: 432,493

[22] Filed: Jan. 11, 1974

[30] Foreign Application Priority Data

Jan. 15, 1973 France ..... 73.01332

[51] Int. Cl.[2] ..... A47L 1/08; A47L 13/12; B43M 11/06

[52] U.S. Cl. ..... 401/25; 401/198; 401/202

[58] Field of Search ..... 401/202, 29, 34, 198, 401/199, 207, 23, 25, 26

[56] References Cited

U.S. PATENT DOCUMENTS

| | | | |
|---|---|---|---|
| 2,962,743 | 12/1960 | Henriksson | 401/202 X |
| 3,353,899 | 11/1967 | Hechtle | 401/198 |
| 3,355,239 | 11/1967 | Albrecht | 401/198 X |
| 3,757,782 | 9/1963 | Aiken | 401/34 X |

FOREIGN PATENT DOCUMENTS

| | | | |
|---|---|---|---|
| 501,839 | 3/1951 | Belgium | 401/26 |
| 526,736 | 3/1955 | Italy | 401/199 |
| 928,144 | 6/1963 | United Kingdom | 401/202 |

*Primary Examiner*—Lawrence Charles
*Attorney, Agent, or Firm*—Robert E. Burns; Emmanuel J. Lobato; Bruce L. Adams

[57] ABSTRACT

An applicator comprising a reservoir and two applicator pads for applying a liquid, semi-liquid or pasty adhesive contained in the reservoir. Each pad has a duct extending therethrough parallel to the main axis of the reservoir which is preferably tubular. A removable hollow cover is provided at each end of the reservoir, the covers enclosing the pads. Each cover has a pin projecting therefrom and extending through the duct in the pad. The pin acts as a piston in its duct when a cover is removed and replaced at one end of the reservoir, forcing adhesive through the duct at the other end of the reservoir from which the cover has been removed.

The pads are of sponge or flexible porous foamed plastics, and may be of different sizes. The size of each duct and its related pin are related to the size of the associated applicator pad.

4 Claims, 1 Drawing Figure

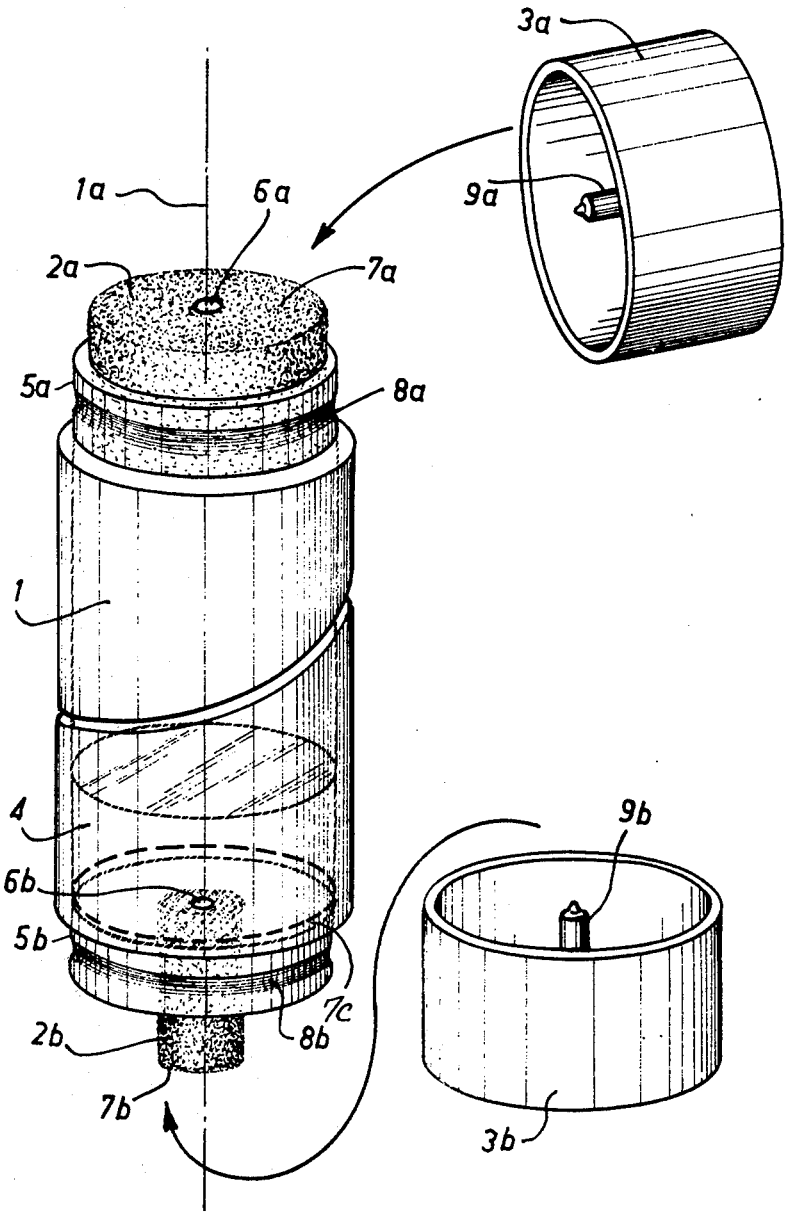
3a
1a
6a
9a
2a
7a
5a
8a
1
4
9b
6b
5b
7c
2b
8b
7b
3b

APPLICATOR

BACKGROUND OF THE INVENTION

This invention relates to an applicator having a reservoir and two applicator pads, and capable of being used particularly for the application of a liquid, semi-liquid or pasty adhesive.

Applicators which have one or two applicator pads having in general the shape of a plug of a flexible and porous material, such as sponge, are known.

Such a device is described in Belgian Patent No. 501,839, in which there is disclosed a wick associated with each pad so as to permit these pads to be impregnated by capillarity. This device possesses however the disadvantage of not being suitable for pasty or semi-liquid products, which are not able to impregnate applicator pads by capillarity in a satisfactory manner.

Humidification devices having two applicators are also known, which comprise two sponge pads or plugs situated at each of the ends of a tube and protected by removable covers. Such a device is described in German Patent No. 385,444. It is however not possible with this humidification device to store a large quantity of product, nor does it solve the problem arising when pasty or semi-liquid products are used.

This latter problem is solved in the particular case of French Patent No. 1,056,718, which describes a lipstick case, comprising an internally threaded storage tube comprising an orifice at one of its ends; a nozzle can be screwed into the storage tube and pierce right through; two caps can be used to close the open end of the storage tube on the one hand, and the open end of the nozzle on the other hand. This accessory is used in the following manner: the cap is removed from the nozzle, the nozzle is screwed into the storage tube thus resulting in supply of the product to the open end of the nozzle by compression (the opposite end of the storage tube being hermetically closed by the other cap). The same method is used to make use of the other end of this accessory. This accessory is however relatively complex and therefore expensive, and therefore cannot be thrown away after use as is desirable for a tube of adhesive.

The first objective of the present invention is therefore to provide an applicator having two applicator pads, which is simple in its construction, therefore inexpensive, and which can be thrown away after use.

The second objective of the invention is to provide an applicator having two applicator pads, which is suitable for the storage of semi-liquid or pasty products, for example adhesive, and in which the impregnating of the applicator pads is carried out in a convenient manner without the use of a wick or a complex mechanical device.

The third objective of the invention is to provide an applicator having two applicator pads enabling different quantities of product to be applied for each of the applicator pads.

SUMMARY OF THE INVENTION

According to the invention there is provided an applicator comprising:

a reservoir open at opposed ends along a principal axis;

an applicator pad at each end of the reservoir for applying a product contained in the reservoir;

each applicator pad having at least one duct extending through the pad in a direction parallel to, or substantially parallel, to said principal axis;

two removable covers secured to respective ends of the reservoir and enclosing the pads; and at least one of the covers having one or more pins, equal in number to the number of ducts, projecting from the cover, each pin extending through a respective duct;

whereby when using the applicator to apply a liquid or pasty product such as an adhesive contained in the reservoir, removal and replacement of a cover having a pin or pins at one end of the reservoir causes the or each pin of said cover to function as a piston in its associated duct thereby forcing product from the reservoir through each duct at the other end of the reservoir from which the cover has been removed.

BRIEF DESCRIPTION OF THE DRAWING

An embodiment of the invention will now be described by way of example, with reference to the accompanying drawing which is a perspective view of an applicator having two applicator pads according to the invention, the covers of which have been removed.

DESCRIPTION OF THE PREFERRED EMBODIMENT

An applicator according to the invention comprises a reservoir 1 of elongate form and having a principal axis 1*a*, two applicator pads or plugs 2*a*, 2*b* and two covers 3*a*, 3*b*.

The reservoir 1 is for example cylindrical but any other suitable shape is equally acceptable. The material constituting the reservoir is preferably transparent or translucid, thus enabling the user to observe the level of a product 4 contained in the reservoir 1. However, the reservoir may also be opaque.

The two pads 2*a*, 2*b* are integrally secured to the reservoir 1 respectively at its two ends 5*a* and 5*b*. They extend from this reservoir 1 in both axial directions outwards along the axis 1*a*. They are constituted of a supple and porous material such as sponge or a plastic foam. Two ducts 6*a*, 6*b* shown, one for each pad and passing through the respective one of the two pads 2*a*, 2*b*. These two ducts 6*a* and 6*b*, extending substantially parallel to the principal axis 1*a*, communicate at their internal ends with the reservoir 1 and open out at their external ends onto the working surfaces 7*a* and 7*b* of the pads 2*a* and 2*b* respectively. The working surfaces 7*a* and 7*b* are respectively the surfaces of the pads 2*a* and 2*b* which are brought into contact with the surface to be covered by the product 4.

In order to extend the range of use of the applicator the working surfaces 7*a* and 7*b* are of different areas. For example, the area of the working surface 7*a* is greater than the area of the working surface 7*b*. The working surface 7*a* of the pad 2*a* is used for coating large areas, while the working surface 7*b* of the pad 2*b* is used for coating small areas or for applying a finishing coat.

The two applicator pads 2*a* and 2*b* are integrally secured to the reservoir 1 in any appropriate manner. In one non-limiting construction each pad 2*a*, 2*b* is fixed onto a support plate having substantially the same shape and the same area as the working surface 7*a*, 7*b*. These plates are perforated by orifices, opposite the ducts 6*a* and 6*b* respectively. The support plates in question are fixed to the two ends 5*a* and 5*b* forming necks of the reservoir 1. The lower support plate *7C* is visible in the drawing.

The applicator is so designed that the quantity of product to be applied shall be a function of the area of the working surface *7a*, *7b* of the applicator pads *2a*, *2b*.

For this purpose, it is provided that the orifice of the support plate *7c* associated with the pad *2a* having the working surface *7a* is greater than that of the support plate associated with the pad *2b* having the smaller working surface *7b*.

By way of example, given in a non-limiting and purely illustrative context, an applicator with two applicator pads and having the following characteristics has been produced:

Effective volume of reservoir: approximately 30 $cm^3$.
Working surface *7a:* approximately 4.2 $cm^2$.
Working surface *7b:* approximately 1.6 $cm^2$.

Each pad *2a*, *2b* is perforated respectively by a duct *6a*, *6b*.

The orifices of the support plates associated with the pads *2a*, *2b* are respectively 2.5 and 1.4 mm in diameter.

The ends *5a*, *5b* of the reservoir are provided with appropriate means for removing the air compressed between the cover and the corresponding pad. Thus, in the embodiment shown in the drawing, the ends *5a* and *5b* are provided respectively with an annular groove *8a*, *8b* permitting the air to be removed.

The two covers *3a*, *3b* are designed to be fitted to the reservoir 1 at each of its two ends. They protect the two pads *2a*, *2b*. Each cover *3a*, *3b* comprises an internal pin, respectively *9a*, *9b*, which can enter the duct *6a* or *6b* of the respective pad *2a* or *2b*. The two covers *3a*, *3b* are so constructed that they can be securely fixed to the ends of the reservoir 1 without the possibility of coming off in an unintended manner. This result can be obtained by any conventional device, such as ducts and grooves or alternatively by friction.

The length of the pins *9a* *9b* is substantially equal to the thickness of the pads *2a*, *2b*, so that the pins pass through the pads totally or substantially totally, but without the pads *2a*, *2b* being crushed. As will be seen later, the pins constitute pistons and promote the flow of product 4 from the reservoir.

According to one important constructional arrangement, the pins *9a*, *9b* are of frusto-conical shape. The free end of each preferably constitutes a point.

In addition, the position of the support plates with respect to the pin of the corresponding fitted cover is determined as a function of the magnitude of the orifice formed in this support plate.

Thus, the pin *9a* of the cover *3a* passes substantially further through the support plate associated with the pad *2a* than the pin *9b* passes through the support plate associated with the pad *2b*.

The method of operating the applicator according to the invention is as follows: when it is desired to use one of the pads, for example the pad *2b*, the cover *3b* associated with this pad is first removed, while holding the reservoir in a vertical or substantially vertical position with the pad *2b* directed downwards as shown in the drawing. The upper cover *3a* is then removed from the end *5a* of the reservoir, and is then replaced causing the pin *9a* to slide in the duct *6a*. In this operation, the pin *9a* fulfills the function of a piston which compresses the air in the reservoir, thereby causing the product 4 to be discharged through the lower duct *6b*. The annular groove *8a* enables air, compressed between the cover *3a* and the pad *2a* of the reservoir, to escape.

If it is desired to utilise a larger quantity of product 4, the removal and replacement of the cover *3a* just described can be carried out several times, thus promoting on each occasion transference of the product 4.

It is of course possible to use each pad either as an applicator or as an element associated with the corresponding cover, the pin of which forms a piston. The two covers *3a*, *3b* are interchangeable.

The invention may form the subject of numerous variants. These variants relate notably to the shape of the reservoir 1, the shape of the pads *2a*, *2b* and the method of fixing these pads to the reservoir 1. It is of course clearly to be understood that each pad may comprise a number of ducts, with which a number of pins in the corresponding cover are associated.

I claim:

1. An applicator comprising;

a reservoir for a viscous fluid product, the reservoir having an axis and having two axially opposed ends;

means for applying said product, comprising two applicator pads, each secured to and generally closing one of said ends of the reservoir, said applicator pads having duct means defining ducts which extend through the pads in directions substantially parallel to said axis;

two support plates, each for one of said applicator pads, each support plate defining an orifice opposite a duct of the respective pad, the two support plates being rigidly mounted in the reservoir at the respective ends of the reservoir to support the respective pads;

two removable covers each applicable to one of said ends of the reservoir and, when so applied, enclosing the respective pad; and pin means on each cover, projecting from the cover, said pin means extending through said ducts when said covers are applied to said ends;

whereby removal and renewed application of a cover, pursuant to removal of the other cover and downward disposition of the corresponding pad, enables the pin means of the first named cover to function as piston means for downwardly forcing parts of the product from the reservoir, through the downwardly disposed support plate orifice and applicator pad.

2. An applicator according to claim 1 wherein each of said pin means has frusto-conical shape.

3. An applicator according to claim 1 wherein each applicator pad consists of resilient porous material.

4. An applicator according to claim 1 wherein means is provided for removing air compressed between each of said covers and the corresponding pad.

* * * * *